US009745987B2

(12) United States Patent
Kobayashi et al.

(10) Patent No.: US 9,745,987 B2
(45) Date of Patent: Aug. 29, 2017

(54) FAN

(71) Applicant: Nidec Corporation, Kyoto (JP)

(72) Inventors: Makoto Kobayashi, Kyoto (JP); Shinsuke Hamano, Kyoto (JP); Ryota Hayashida, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 702 days.

(21) Appl. No.: 13/666,028

(22) Filed: Nov. 1, 2012

(65) Prior Publication Data

US 2013/0149134 A1 Jun. 13, 2013

(30) Foreign Application Priority Data

Dec. 12, 2011 (JP) ..... 2011-270902

(51) Int. Cl.

| | |
|---|---|
| ***F04D 29/54*** | (2006.01) |
| ***F04D 25/06*** | (2006.01) |
| ***F04D 25/08*** | (2006.01) |
| ***F04D 29/32*** | (2006.01) |
| ***F04D 29/38*** | (2006.01) |

(52) U.S. Cl.

CPC ..... *F04D 25/0613* (2013.01); *F04D 25/082* (2013.01); *F04D 29/329* (2013.01); *F04D 29/384* (2013.01)

(58) Field of Classification Search

CPC ..... F04D 25/0606; F04D 25/0613; F04D 25/082; F04D 29/329

See application file for complete search history.

(56) References Cited

U.S. PATENT DOCUMENTS

| | | | | |
|---|---|---|---|---|
| 4,128,364 | A * | 12/1978 | Papst | F04D 25/062 310/67 R |
| 4,189,975 | A * | 2/1980 | Nisida et al. | 411/423 |
| 6,170,275 | B1 | 1/2001 | Ueno et al. | |
| 6,384,494 | B1 * | 5/2002 | Avidano et al. | 310/58 |
| 6,773,239 | B2 * | 8/2004 | Huang | F04D 25/082 310/62 |
| 7,234,919 | B2 * | 6/2007 | Lee | F04D 29/384 415/208.2 |

(Continued)

FOREIGN PATENT DOCUMENTS

| | | | |
|---|---|---|---|
| JP | 2-188697 | A | 7/1990 |
| JP | 11324994 | A * | 11/1999 |

(Continued)

*Primary Examiner* — Justin Seabe

(74) *Attorney, Agent, or Firm* — Keating & Bennett, LLP

(57) ABSTRACT

A fan includes a stationary portion, a rotating portion, and an impeller arranged to rotate about a central axis together with the rotating portion to produce an axial air current. The rotating portion includes a rotor holder. The impeller includes a cup portion arranged to cover the rotor holder and a plurality of blades arranged on an outer circumference of the cup portion. The cup portion includes a cup cover portion arranged to extend radially outward from the central axis; a cup cylindrical portion being substantially cylindrical in shape, and arranged to extend in an axial direction from an outer edge portion of the cup cover portion; and a cup through hole arranged to extend through the cup portion at a position overlapping with a portion or boundary between the cup cover portion and the cup cylindrical portion.

12 Claims, 15 Drawing Sheets

(56) References Cited

U.S. PATENT DOCUMENTS

| | | | | |
|---|---|---|---|---|
| 7,300,262 | B2 * | 11/2007 | Ku | F04D 25/082 310/58 |
| 7,329,091 | B2 * | 2/2008 | Yan | F04D 29/542 415/191 |
| 2004/0075356 | A1 * | 4/2004 | Horng et al. | 310/154.08 |
| 2004/0265125 | A1 | 12/2004 | Spaggiari | |
| 2008/0219845 | A1 * | 9/2008 | Chen | F04D 29/329 416/95 |
| 2010/0183437 | A1 * | 7/2010 | Huang et al. | 415/220 |
| 2011/0255957 | A1 * | 10/2011 | Inada et al. | 415/119 |
| 2012/0121410 | A1 * | 5/2012 | Liu | F04D 29/662 415/220 |

FOREIGN PATENT DOCUMENTS

| | | | |
|---|---|---|---|
| JP | 2000-152547 | A | 5/2000 |
| JP | 2009-156230 | A | 7/2009 |

* cited by examiner

FAN

BACKGROUND OF THE INVENTION

1. Field of the Invention

The present invention relates to a fan and more specifically, to a fan preferably for use in a high humidity environment.

2. Description of the Related Art

JP-A 2000-152547 discloses a fan apparatus arranged to circulate air inside a refrigerator. The fan apparatus includes a motor frame, a stator, a bearing, a rotor, and a fan. A tubular portion arranged in a center of the motor frame is press fitted to the stator. The bearing is arranged inside the tubular portion. The stator is molded with a molding layer made of a synthetic resin except in an inner circumferential surface of a stator core. The rotor includes a rotating shaft, a cup-shaped rotor yoke, and a rotor magnet. The rotating shaft is inserted in the bearing. An upper portion of the rotating shaft is fixed to the rotor yoke. The rotor magnet is arranged on a cylindrical portion of the rotor yoke. The fan includes a base portion arranged to cover the rotor yoke, and blade portions arranged to project outward from the base portion. The fan apparatus is installed in a cooling compartment of the refrigerator with an opening of the rotor yoke facing obliquely downward.

In the case of a fan used in a high humidity environment, such as in a refrigerator or the like, a freezing or accumulation of water in a space between an impeller and a rotating portion of a motor may happen. This may lead to unbalanced rotation of the impeller during driving of the fan. Moreover, accumulation of frost in a space inside the impeller or the rotating portion may lead to a disturbance of the rotation of the impeller, i.e., a so-called impeller lock, because of a contact of the frost with a stationary portion.

SUMMARY OF THE INVENTION

According to a preferred embodiment of the present invention, a fan preferably for use in a high humidity environment includes a stationary portion; a rotating portion; a bearing mechanism arranged to support the rotating portion such that the rotating portion is rotatable with respect to the stationary portion; and an impeller arranged to rotate about a central axis together with the rotating portion to produce an axial air current. The stationary portion includes a stator and a base portion arranged to directly or indirectly support the stator. The rotating portion includes a rotor magnet arranged on a radially outer side of the stator and a rotor holder including a cylindrical magnet holding portion arranged to hold the rotor magnet thereinside. The impeller includes a cup portion arranged to cover the rotor holder, and a plurality of blades arranged on an outer circumference of the cup portion. The cup portion includes a cup cover portion arranged to extend radially outward from the central axis; a cup cylindrical portion being cylindrical or substantially cylindrical in shape, and arranged to extend in an axial direction from an outer edge portion of the cup cover portion to surround the cylindrical magnet holding portion; and a cup through hole arranged to extend through the cup portion at a position overlapping with a portion or boundary between the cup cover portion and the cup cylindrical portion.

Preferred embodiments of the present invention enable water inside a fan to be discharged out of the fan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
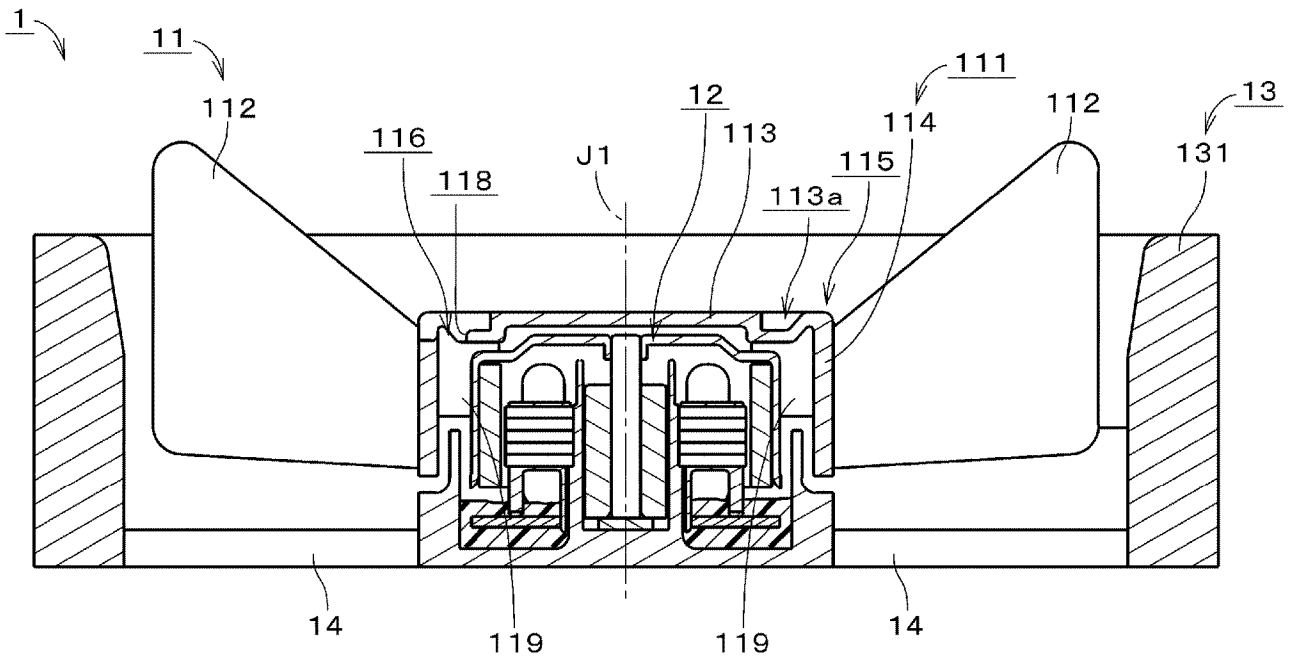
FIG. 1 is a cross-sectional view of a fan according to a first preferred embodiment of the present invention.

It is assumed herein that a vertical direction is defined as a direction in which a central axis of a motor extends, and that an upper side and a lower side along the central axis in FIG. 1 are referred to simply as an upper side and a lower side, respectively. It should be noted, however, that the above definitions of the vertical direction and the upper and lower sides should not be construed to restrict relative positions or directions of different members or portions when the motor is actually installed in a device. Also note that a direction parallel to the central axis is referred to by the term "axial direction", "axial", or "axially", that radial directions centered on the central axis are simply referred to by the term "radial direction", "radial", or "radially", and that a circumferential direction about the central axis is simply referred to by the term "circumferential direction", "circumferential", or "circumferentially".

First Preferred Embodiment

FIG. 1 is a cross-sectional view of a fan 1 according to a first preferred embodiment of the present invention. The fan 1 is an axial fan arranged to produce an axial air current, and is preferably used, for example, to circulate a cool air in a freezer compartment of a refrigerator. The fan 1 preferably includes an impeller 11, a motor 12, a housing 13, and a plurality of support ribs 14. The impeller 11 is caused by the motor 12 to rotate about a central axis J1.

The impeller 11 is preferably made of, for example, a resin, and includes a cup portion 111 and a plurality of blades 112. The cup portion 111 is preferably arranged substantially in the shape of a covered cylinder. The cup portion 111 is fixed to the motor 12. The cup portion 111 preferably includes a cup cover portion 113, a cup cylindrical portion 114, and a rib 119. The cup cover portion 113 is arranged to extend perpendicularly or substantially perpendicularly to and radially outward from the central axis J1. The cup cover portion 113 preferably includes an annular recessed portion 113*a* arranged to be recessed downward from an upper surface thereof. The cup cylindrical portion 114 preferably is cylindrical or substantially cylindrical in shape and centered on the central axis J1. The cup cylindrical portion 114 is arranged to extend in an axial direction from an outer edge portion of the cup cover portion 113. The rib 119 is arranged to project radially inward from an inner circumferential surface of the cup cylindrical portion 114 and also extend in the axial direction. The blades 112 are arranged to extend radially outward from an outer circumferential surface of the cup cylindrical portion 114, and are centered on the central axis J1.

Figure 2:
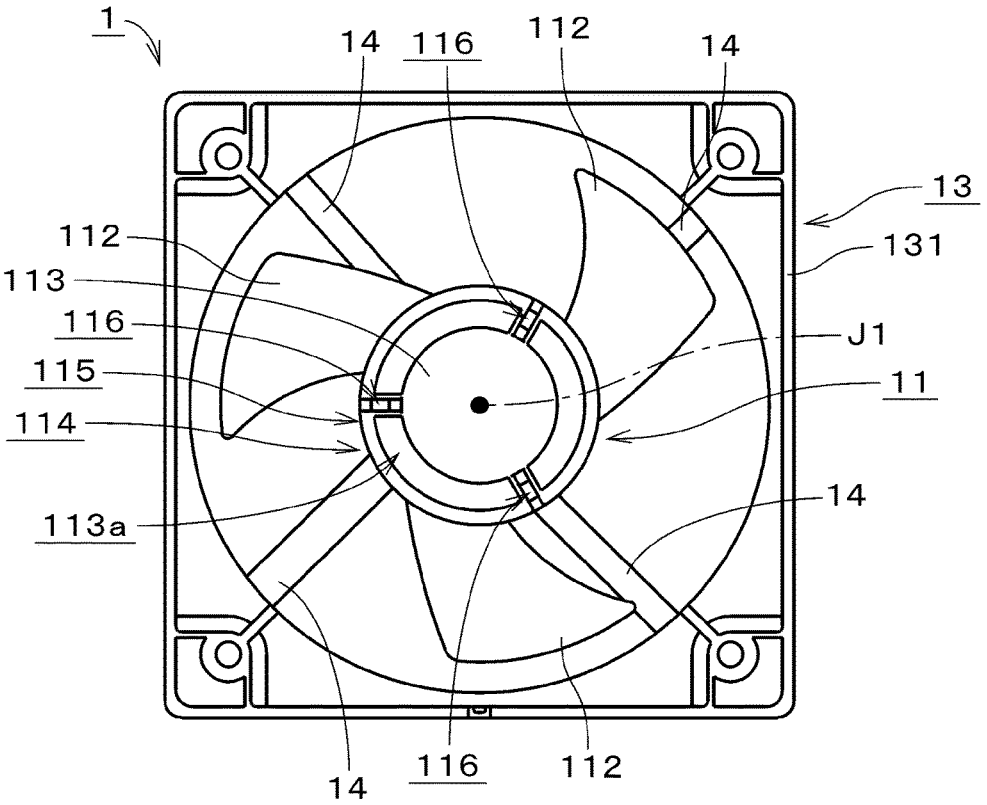
FIG. 2 is a plan view of the fan according to a preferred embodiment of the present invention.

FIG. 2 is a plan view of the fan 1. Referring to FIGS. 1 and 2, the cup portion 111 preferably further includes a corner portion 115 at a boundary between the cup cover portion 113 and the cup cylindrical portion 114 and its vicinity, and a plurality of cup through holes 116 are defined in the corner portion 115. Each of the cup through holes 116 is arranged to extend through the cup portion 111 in the axial direction. Each cup through hole 116 is arranged to overlap with a portion of a bottom portion of the recessed portion 113*a* in the axial direction. Specifically, each cup through hole 116 extends all the way through the cup cylindrical portion 114 such that a lower opening portion is provided on an axially lower side of the cup through hole 116 such that an inner portion of the cup portion is continuously connected to an outside of the cup portion through the cup through hole 116. The recessed portion 113*a* is preferably arranged to rise in a region extending substantially in a radial direction along each circumferential edge of each cup through hole 116. An upper surface of each such region is flush with an upper surface of a central portion of the cup cover portion 113. In other words, the recessed portion 113*a* is locally nonexistent in the vicinity of each cup through hole 116. This makes it easier to apply a balancing material to the recessed portion 113*a* while avoiding the cup through holes 116, and moreover reduces the likelihood that, when at least a portion of the balancing material falls off, the fallen-off balancing material will enter into any cup through hole 116.

As illustrated in FIG. 1, a top portion of the cup cylindrical portion 114 of the cup portion 111 is preferably cut off in the radial direction. Moreover, a portion of a radially inner portion of an inner circumferential surface 118 defining each cup through hole 116 is arranged to be visible from a radially outer side (more precisely, from the radially outer side in a direction perpendicular or substantially perpendicular to the central axis J1).

As illustrated in FIG. 2, the housing 13 is preferably arranged to assume a substantially square or rectangular shape when viewed along the central axis J1. As illustrated in FIGS. 1 and 2, the housing 13 includes a side wall portion 131 arranged to surround the blades 112. The housing 13 is preferably joined to the motor 12 through the support ribs 14 as illustrated in FIG. 1. In the fan 1, the impeller 11 is caused by the motor 12 to rotate about the central axis J1 to produce an air current flowing downward from above in FIG. 1, that is, from this side toward the far side of the page of FIG. 2.

Figure 3:
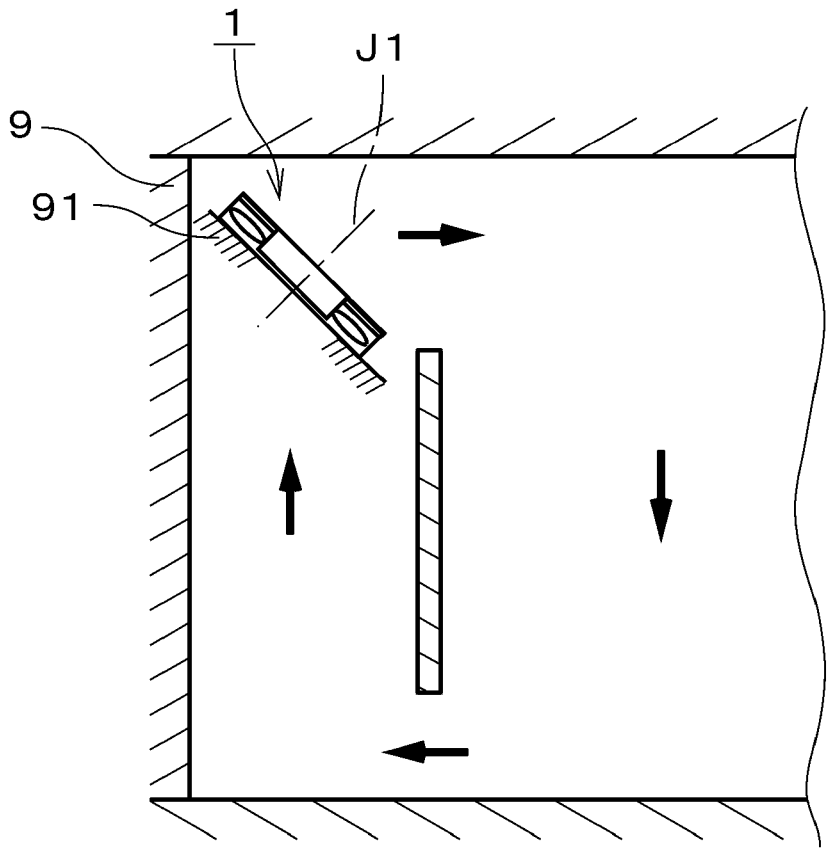
FIG. 3 is a diagram illustrating arrangement of the fan in a freezer compartment according to a preferred embodiment of the present invention.

FIG. 3 is a diagram illustrating an arrangement of the fan 1 inside a freezer compartment 9 in accordance with a preferred embodiment of the present invention. In FIG. 3, the fan 1 is shown schematically. The fan 1 is preferably attached to an attachment target 91 with the central axis J1 inclined with respect to the direction of gravity. The attachment target is arranged in an air-blowing channel in the freezer compartment 9. Inside the freezer compartment 9, the fan 1 is arranged to blow an air obliquely upward, so that a clockwise air current is produced in FIG. 3.

Figure 4:
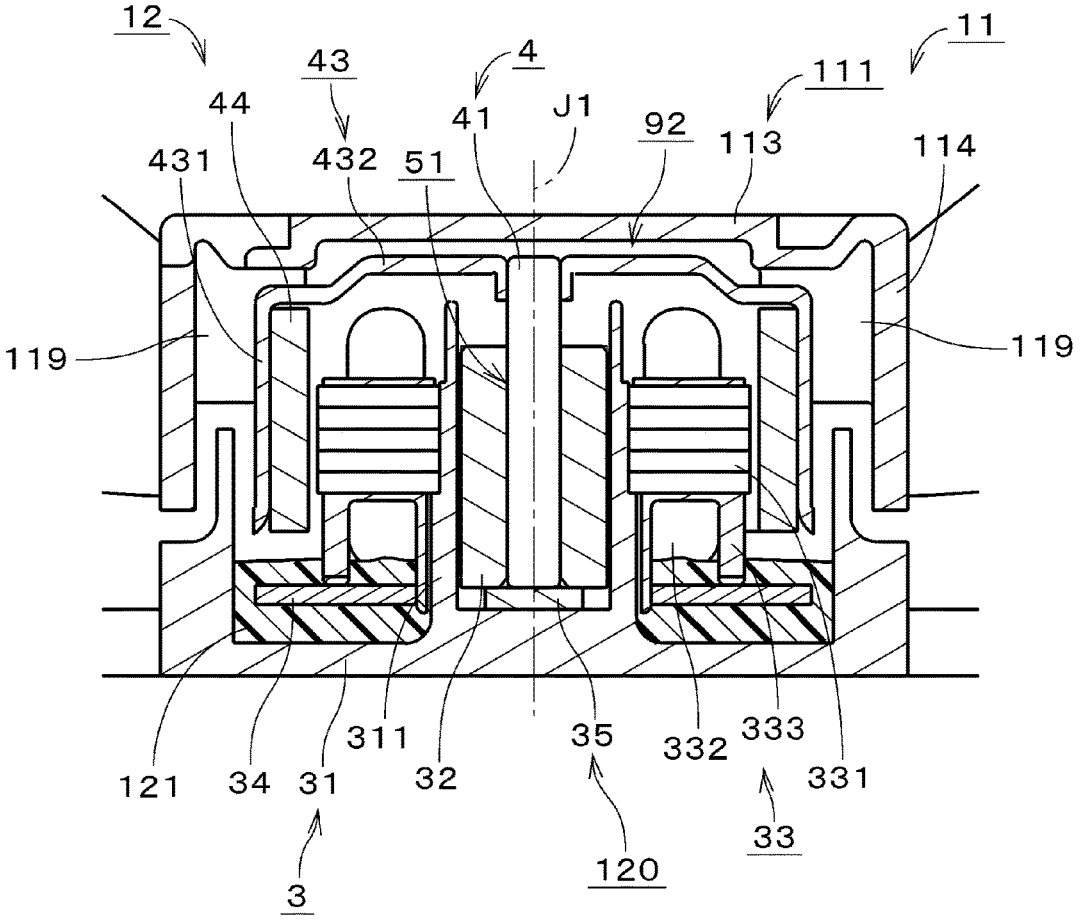
FIG. 4 is a cross-sectional view of the fan according to a preferred embodiment of the present invention.

FIG. 4 is a cross-sectional view of the motor 12 of the fan 1 and its vicinity. The motor 12 is preferably an outer-rotor type. The motor 12 includes a stationary portion 3 and a rotating portion 4. The stationary portion 3 includes a base portion 31, a bearing portion 32, a stator 33, a circuit board 34, and a thrust plate 35. In the fan 1, the support ribs 14 and the housing 13 illustrated in FIG. 1 and the base portion 31 are preferably defined by a single continuous monolithic member. The base portion 31 preferably includes a bearing housing 311 which preferably is cylindrical or substantially cylindrical in shape and centered on the central axis J1. The bearing housing 311 is arranged to extend upward from a central portion of the base portion 31. The thrust plate 35 is arranged on an inner bottom surface of the bearing housing 311 of the base portion 31.

The bearing portion 32 preferably is cylindrical or substantially cylindrical in shape and centered on the central axis J1. The bearing portion 32 is a metallic sintered body impregnated with a lubricating oil. The bearing portion 32 is held inside the bearing housing 311. The stator 33 preferably includes a stator core 331, coils 332, and an insulator 333. An inner circumferential surface of the stator core 331 is fixed to an outer circumferential surface of the bearing housing 311, so that the stator 33 is supported by the base portion 31. Each coil 332 is preferably defined around the stator core 331 with the insulator 333 intervening therebetween. The circuit board 34 is arranged below the stator 33. In the stationary portion 3, the circuit board 34 is preferably covered with, for example, a resin material 121, i.e., a potting compound. This prevents water or dust from being adhered to the circuit board 34. The stator 33 is preferably covered with an insulating varnish. This contributes to reducing the size of the cup portion 111 and increasing the size of the blades 112 compared to the case where the stator 33 is molded with a thick resin. The same is preferably true of other preferred embodiments of the present invention described below.

The rotating portion 4 includes a shaft 41, a rotor holder 43, and a rotor magnet 44. The shaft 41 is inserted in the bearing portion 32. A bottom portion of the shaft 41 is arranged to be in axial contact with the thrust plate 35. The rotor holder 43 preferably has substantially the shape of a covered cylinder and centered on the central axis J1. The rotor holder 43 is covered with the cup portion 111. The rotor holder 43 preferably includes a cylindrical magnet holding portion 431 and a holder cover portion 432. The cylindrical magnet holding portion 431 is surrounded by the cup cylindrical portion 114. The rotor magnet 44 is held inside the cylindrical magnet holding portion 431. During driving of the motor 12, a torque is produced between the stator 33 and the rotor magnet 44, which is arranged on a radially outer side of the stator 33.

The holder cover portion 432 is arranged to extend radially inward from an end portion of the cylindrical magnet holding portion 431 on an upper side in FIG. 4, that is, an end portion of the cylindrical magnet holding portion 431 on a side closer to the cup cover portion 113. A hole portion is defined in a center of the holder cover portion 432, and a top portion of the shaft 41 is fixed in the hole portion. The rotor holder 43 is preferably, for example, press fitted to the cup portion 111 with the rib 119 intervening therebetween. A space 92 is defined between the rotor holder 43 and the cup portion 111.

During the driving of the motor 12, the shaft 41 is preferably supported in the radial direction by the bearing portion 32 through lubricating oil arranged in a radial gap 51 defined between the shaft 41 and the bearing portion 32. Moreover, the bottom portion of the shaft 41 is supported in the axial direction by the thrust plate 35. The shaft 41, the bearing portion 32, the thrust plate 35, and the lubricating oil are thus arranged to together define a bearing mechanism 120 arranged to support the rotating portion 4 such that the rotating portion 4 is rotatable with respect to the stationary portion 3.

Figure 5:
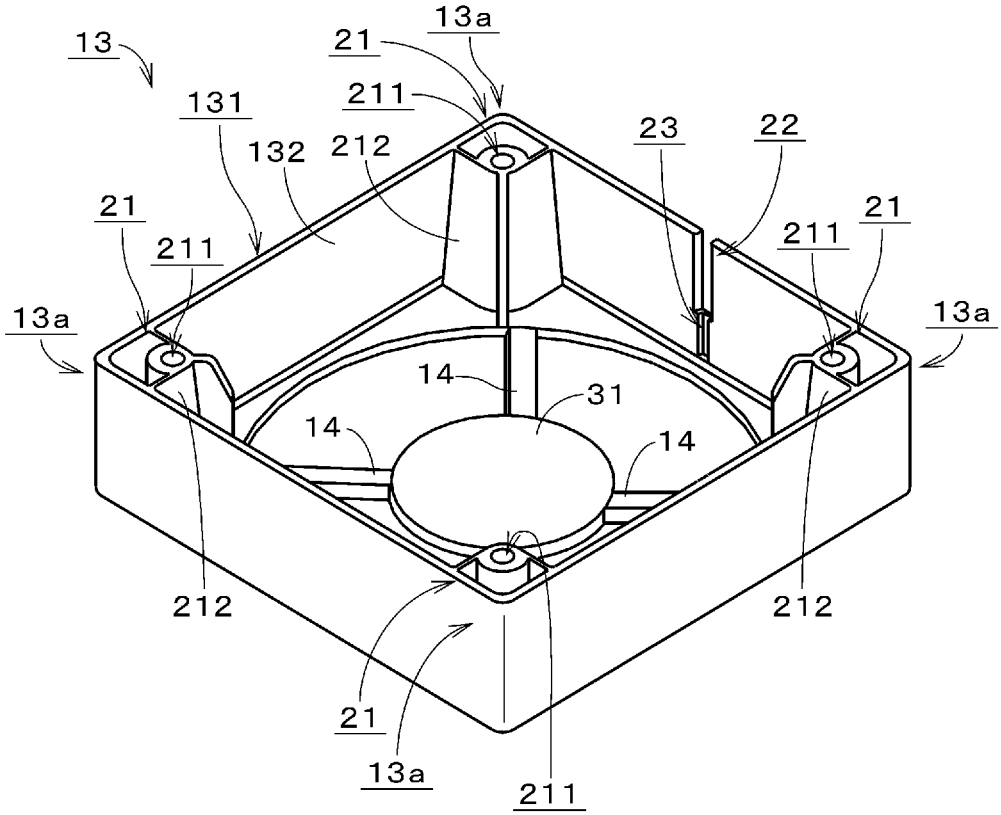
FIG. 5 is a perspective view of a housing, support ribs, and a base portion of the fan according to a preferred embodiment of the present invention.
Figure 6:
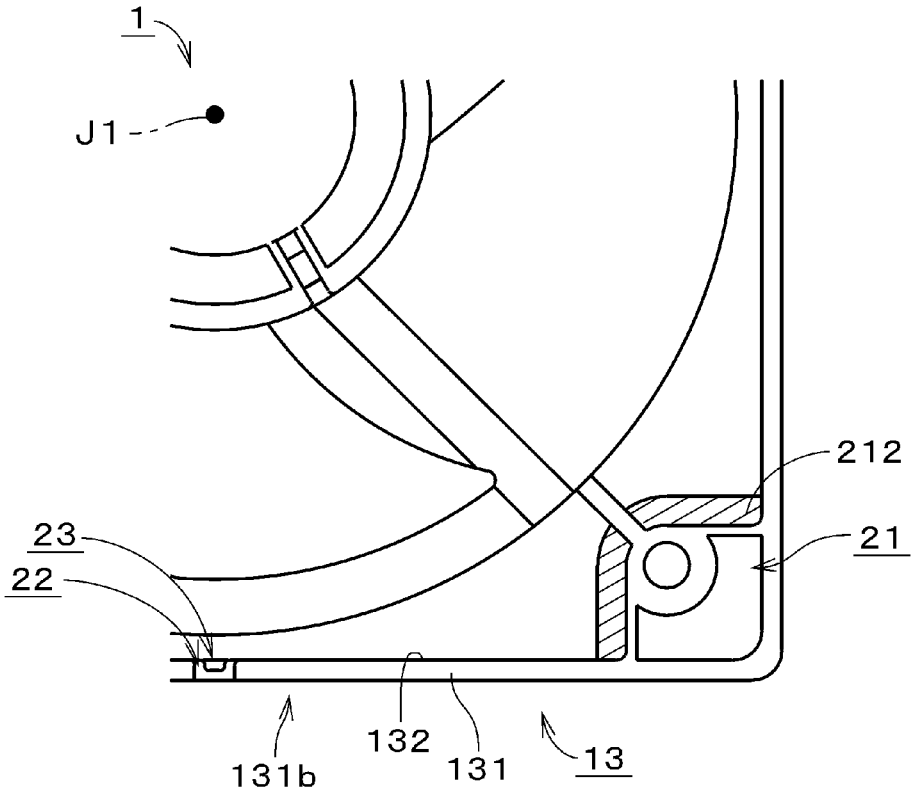
FIG. 6 is a plan view of the fan according to a preferred embodiment of the present invention.

FIG. 5 is a perspective view illustrating the housing 13, the support ribs 14, and the base portion 31. Note, however, that the bearing housing 311 of the base portion 31 is not shown. The side wall portion 131 of the housing 13 preferably includes a plurality of screw hole defining portions 21, a recessed portion 22, and a groove 23. Each screw hole defining portion 21 is defined at a corner portion 13*a* of the housing 13. Each screw hole defining portion 21 is arranged to define a screw hole 211. The screw hole 211 is arranged to extend through the screw hole defining portion 21 in the axial direction. A screw is inserted into each screw hole 211, so that the housing 13 is fixed to the attachment target 91 illustrated in FIG. 3. A radially inner side surface 212 of each screw hole defining portion 21 defines a portion of an inner surface 132 of the side wall portion 131. FIG. 6 is a plan view illustrating a portion of the fan 1. In FIG. 6, the side surface 212 of the screw hole defining portion 21 is indicated by parallel oblique lines. The side surface 212 is preferably an inclined surface arranged to gradually approach the central axis J1 as it extends from an inlet side of the fan 1, i.e., a side in a direction extending out of the page of FIG. 6, toward an outlet side of the fan 1, i.e., a side in a direction extending into the page of FIG. 6.

Figure 7:
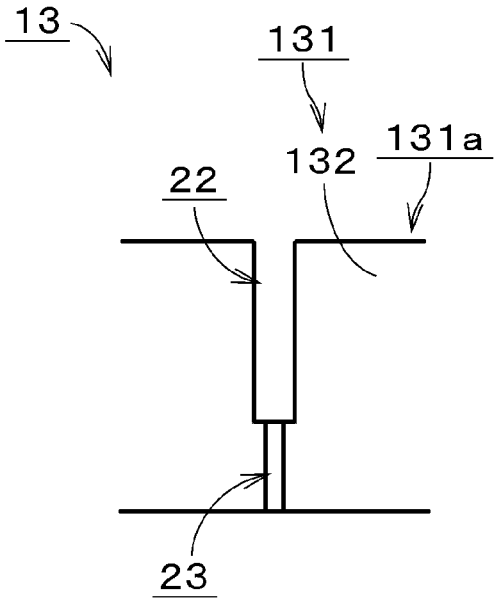
FIG. 7 is a diagram illustrating a recessed portion and a groove portion according to the first preferred embodiment of the present invention.

FIG. 7 is a diagram illustrating the recessed portion 22 and the groove 23 as viewed from an inner side of the housing 13. The recessed portion 22 is arranged to be recessed from an edge 131*a* of the side wall portion 131 on the inlet side, i.e., on an upper side in FIG. 7, toward the outlet side. The groove 23 is defined in the inner surface 132 of the side wall portion 131. The groove 23 is arranged to extend from the recessed portion 22 toward the outlet side. A side 131*b* of the side wall portion 131 in which the recessed portion 22 is defined as illustrated in FIG. 6 is arranged to face downward in the direction of gravity inside the freezer compartment 9.

Figure 8:
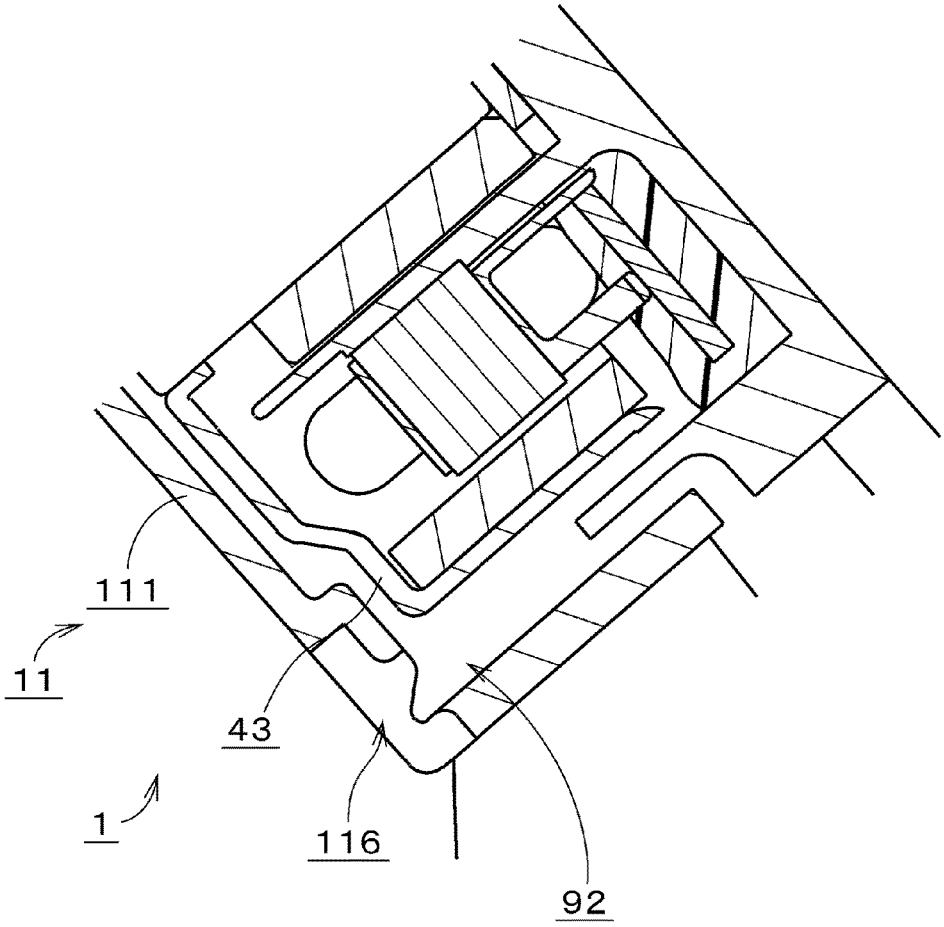
FIG. 8 is a cross-sectional view of the fan according to a preferred embodiment of the present invention.

FIG. 8 is a cross-sectional view illustrating a portion of the fan 1 in a situation in which the fan 1 is attached to the attachment target 91 illustrated in FIG. 3. When a defrosting operation of the refrigerator is carried out, frost adheres to a surface of the cup portion 111 and a surface of the rotor holder 43 changes into water droplets. Since the fan 1 is arranged inside the freezer compartment 9 with the impeller 11 turned upside down, water accumulates in the space 92 between the cup portion 111 and the rotor holder 43. Since each cup through hole 116 is arranged in a lower portion of the impeller in the direction of gravity, the water in the space 92 is discharged out of the cup portion 111 through the cup through holes 116. Moreover, rotation of the fan 1 produces a centrifugal force acting on the water in the space 92, and this increases efficiency with which the water is discharged out of the cup portion 111 through the cup through holes 116.

As described above, the side 131*b* in which the recessed portion 22 is defined as illustrated in FIG. 6 is arranged to face downward in the direction of gravity. Therefore, water droplets adhered to the inner surface 132 of the side wall portion 131 gather on the side 131*b*, and are discharged out of the housing 13 through the recessed portion 22. In addition, the groove 23 is arranged to extend from an end portion of the recessed portion 22 on the outlet side, i.e., on the far side of the page of FIG. 6, toward the outlet side. This enables water accumulated on a portion of the housing 13 on the outlet side to be easily led into the recessed portion 22. The side surface 212 of each screw hole defining portion 21 is arranged to gradually approach the central axis J1 as it extends from the inlet side of the fan 1 toward the outlet side of the fan 1. Therefore, an upper portion of the side surface 212 illustrated in FIG. 6 is significantly inclined downward in the direction of gravity as it extends from the outlet side toward the inlet side, so that an inlet end thereof is positioned on a lower side in the direction of gravity. This enables a water droplet which has flowed to the side surface 212 from above to easily flow toward an end portion of the side surface 212 on the inlet side.

The fan 1 according to the first preferred embodiment has been described above. The cup through holes 116 provided in the cup portion 111 enable water which may be present between the cup portion 111 and the rotor holder 43 to be easily discharged out of the cup portion 111. This contributes to reducing the likelihood that unbalanced rotation of the impeller 11 will occur because of water or frost accumulating inside the cup portion 111, and also contributes to preventing frost accumulated between the cup portion 111 and the rotor holder 43 from being brought into contact with a portion of the stationary portion 3, e.g., the base portion 31, to interfere with rotation of the rotating portion 4 and the impeller 11. The recessed portion 22 provided in the housing 13 enables a water droplet adhered to the inner surface 132 of the side wall portion 131 to be easily discharged out of the housing 13. This contributes to preventing an impeller lock from occurring because of frost being accumulated on the inner surface 132 of the side wall portion 131 of the housing 13.

The radially inner portion of the inner circumferential surface 118 of each cup through hole 116 is exposed radially outward. This enables a water droplet which has traveled to this portion of the inner circumferential surface 118 to be easily discharged out of the cup portion 111 with the help of a centrifugal force. Since each cup through hole 116 is arranged to extend through the cup portion 111 in the axial direction, it is easy to mold the cup through hole 116. The same is preferably true of other preferred embodiments of the present invention described below.

Figure 9:
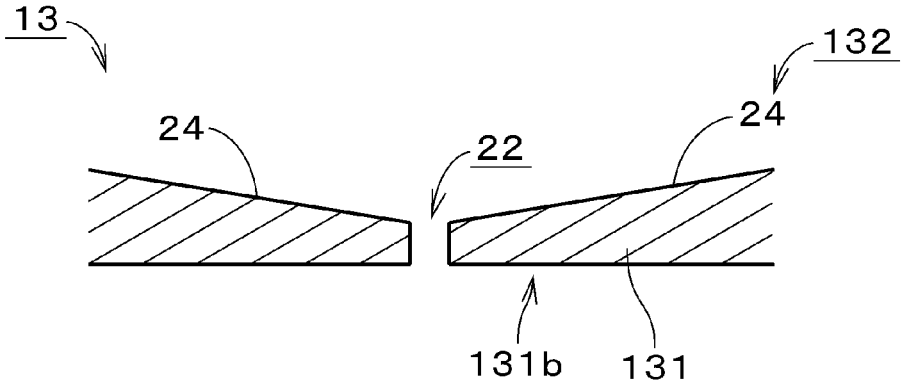
FIG. 9 is a cross-sectional view illustrating a portion of a housing according to a modification of the first preferred embodiment of the present invention.

FIG. 9 is a diagram illustrating a portion of a cross-section of a housing 13 according to a modification of the first preferred embodiment taken along a plane perpendicular to the central axis J1 (see FIG. 6). A portion of an inner surface 132 of a side wall portion 131 of the housing 13, the portion being included in a side 131*b* in which a recessed portion 22 is defined, preferably includes inclined surfaces 24 on both sides of the recessed portion 22. When the housing 13 has been fixed to the attachment target 91 with the side 131*b*, which includes the recessed portion 22, facing downward in the direction of gravity, each inclined surface 24 inclines downward toward the recessed portion 22. By providing the inclined surfaces 24, it is possible to enable a water droplet adhered to the inner surface 132 of the side wall portion 131 to be easily led into the recessed portion 22.

Figure 10:
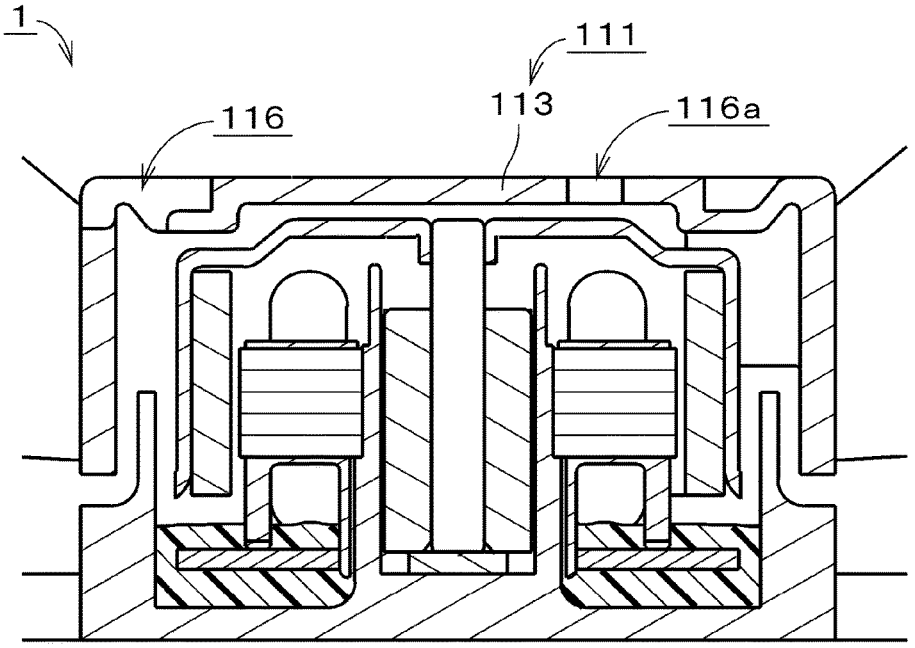
FIG. 10 is a cross-sectional view of a fan according to a modification of the first preferred embodiment of the present invention.

FIG. 10 is a diagram illustrating a fan 1 according to another modification of the first preferred embodiment of the present invention. A cup portion 111 preferably further includes an additional cup through hole 116*a* extending through a cup cover portion 113 in the axial direction on a radially inner side of cup through holes 116. During driving of the fan 1, water inside the cup portion 111 is discharged out of the cup portion 111 through the cup through holes 116 and 116*a*. By providing the cup through hole 116*a*, it is possible to enable water to be discharged out of the cup portion 111 with increased efficiency. The cup through hole 116*a* may also be defined in the cup cover portion 113 in other preferred embodiments of the present invention described below.

Figure 11:
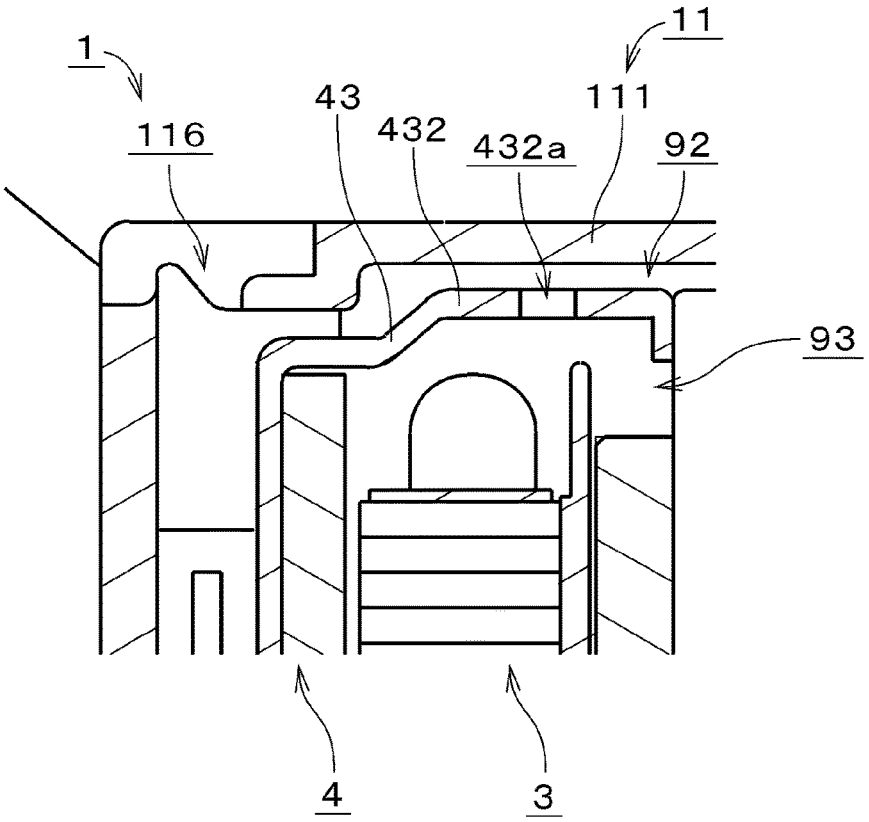
FIG. 11 is a cross-sectional view of a fan according to another modification of the first preferred embodiment of the present invention.

FIG. 11 is a diagram illustrating a fan 1 according to yet another modification of the first preferred embodiment of the present invention. In this fan 1, a holder cover portion 432 includes a holder through hole 432*a* extending therethrough in the axial direction. A space 92 between a rotor holder 43 and a cup portion 111 and a space 93 inside the rotor holder 43 are preferably joined to each other through the holder through hole 432*a*. This makes it possible to discharge water accumulated inside the rotor holder 43. This in turn prevents frost from being accumulated between a rotating portion 4 and a stationary portion 3, and thereby prevents disturbance of rotation of the rotating portion 4 and an impeller 11. Note that the holder through hole 432*a* is preferably arranged at the same circumferential position as that of any of cup through holes 116.

Second Preferred Embodiment

Figure 12:
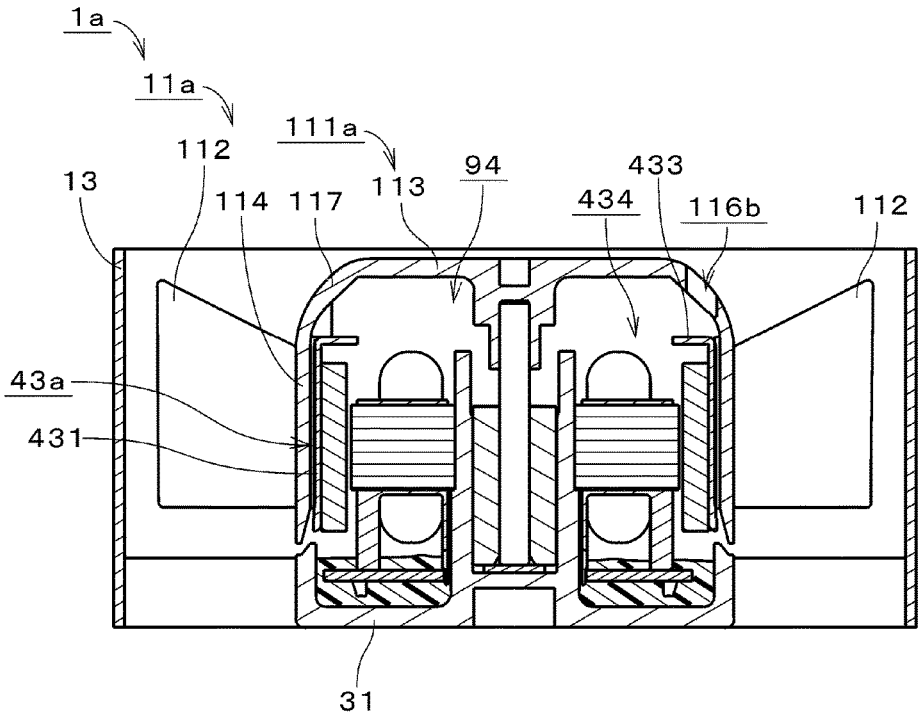
FIG. 12 is a cross-sectional view of a fan according to a second preferred embodiment of the present invention.

FIG. 12 is a diagram illustrating a fan 1*a* according to a second preferred embodiment of the present invention. The fan 1*a* is preferably used, for example, to circulate a cool air in a cooling compartment of a refrigerator. Inside the cooling compartment, the fan 1*a* is preferably attached to an attachment target with an end portion of the fan 1*a* on an inlet side, i.e., an end portion of the fan 1*a* on an upper side in FIG. 12, facing downward or obliquely downward as is the case with the fan 1 illustrated in FIG. 3. The fan 1*a* includes an impeller 11*a* having a shape different from that of the impeller 11 illustrated in FIG. 1. The impeller 11*a* includes a cup portion 111*a* and a plurality of blades 112. The cup portion 111*a* includes a cup cover portion 113, a cup cylindrical portion 114, and a sloping portion 117. The sloping portion 117 is a portion defined between the cup cover portion 113 and the cup cylindrical portion 114, and is arranged to slope toward a base portion 31 with increasing distance from a central axis of the fan 1*a*.

Figure 13:
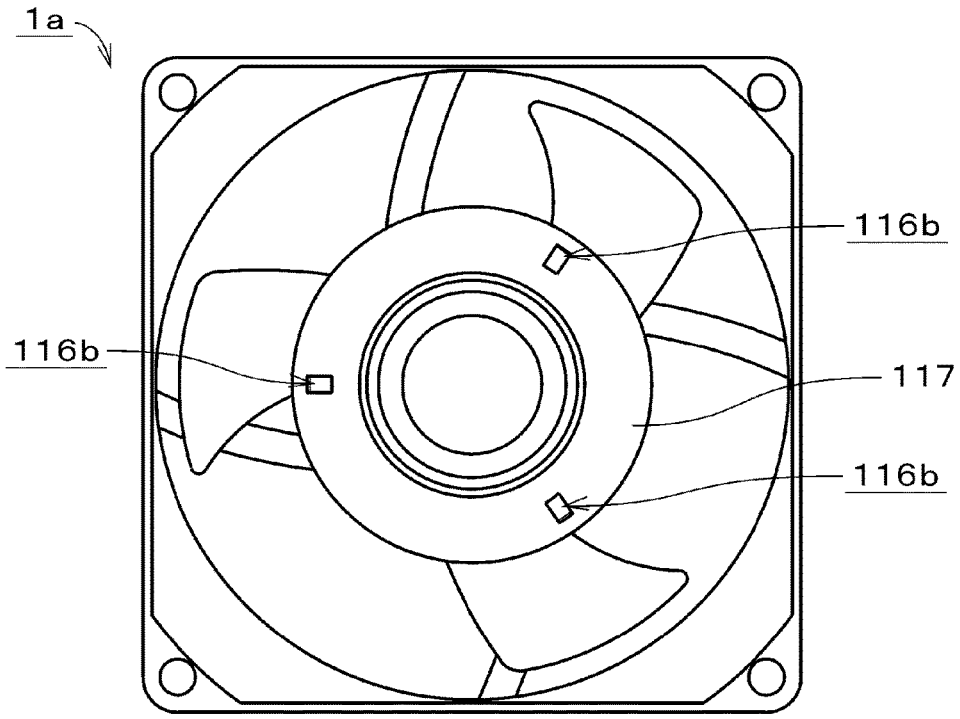
FIG. 13 is a plan view of the fan according to the second preferred embodiment of the present invention.
Figure 14:
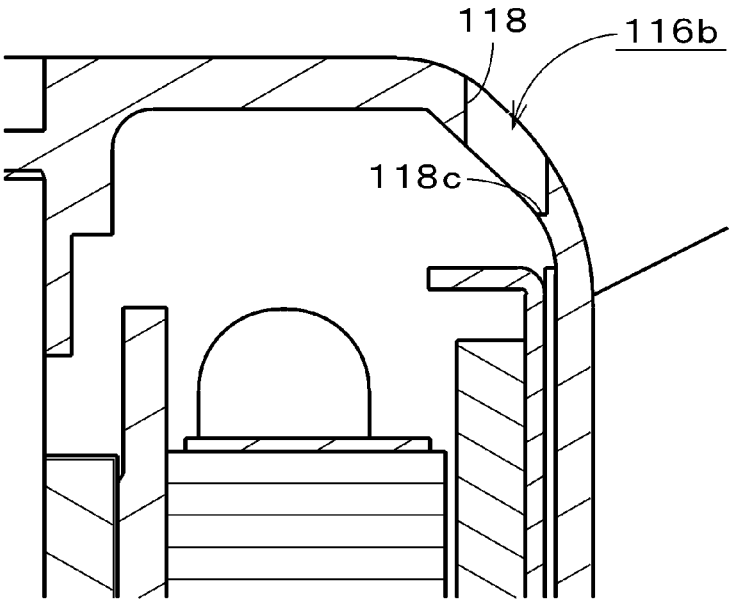
FIG. 14 is a cross-sectional view of the fan according to the second preferred embodiment of the present invention.

FIG. 13 is a plan view of the fan 1*a*. As illustrated in FIGS. 12 and 13, the sloping portion 117 preferably includes cup through holes 116*b* each of which extends through the sloping portion 117 in the axial direction. FIG. 14 is a diagram illustrating one of the cup through holes 116*b* in an enlarged form. An entire radially inner portion of an inner circumferential surface 118 of the cup through hole 116*b* is arranged to be visible from a radially outer side (more precisely, from the radially outer side in a direction perpendicular to the central axis). An entire radially outer portion of the inner circumferential surface 118 is arranged to be visible from a radially inner side (more precisely, from the radially inner side in the direction perpendicular to the central axis). Note that only a portion of the radially inner portion of the inner circumferential surface 118 may be arranged to be visible from the radially outer side. Also note that only a portion of the radially outer portion of the inner circumferential surface 118 may be arranged to be visible from the radially inner side. A small portion 118*c* extending radially inward from a lower end of the radially outer portion of the inner circumferential surface 118 is preferably provided.

A rotor holder 43*a* of the fan 1*a* illustrated in FIG. 12 is substantially cylindrical in shape, and preferably includes a cylindrical magnet holding portion 431 and an annular portion 433. The annular portion 433 is arranged to extend radially inward from a top portion of the cylindrical magnet holding portion 431. A large opening 434 is preferably defined inside the annular portion 433. In the fan 1*a*, a space 94 inside the rotor holder 43*a* and the cup portion 111*a* is in communication with an exterior space of the cup portion 111*a* through the cup through holes 116*b*. The fan 1*a* is otherwise similar in structure to the fan 1 according to the first preferred embodiment. Accordingly, like members or portions are designated by like reference numerals, and redundant description is omitted.

Because the fan 1*a* is installed inside the cooling compartment with the end portion of the fan 1*a* on the inlet side facing obliquely downward as described above, water is accumulated inside the cup cover portion 113. Rotation of the fan 1*a* produces a centrifugal force acting on the water in the space 94, and the water is discharged out of the cup portion 111*a* through the cup through holes 116*b*. The water discharged out of the cup portion 111*a* is discharged out of the fan 1*a* through an end portion of a housing 13 on the inlet side.

The cup through holes 116*b* are preferably defined in the cup portion 111*a* according to the second preferred embodiment. This enables any water that is present inside the cup portion 111*a* to be easily discharged out of the cup portion 111*a*. The radially inner portion of the inner circumferential surface 118 of each cup through hole 116*b* is exposed radially outward. This enables a water droplet which has traveled to this portion of the inner circumferential surface 118 to be easily discharged out of the cup portion 111. The radially outer portion of the inner circumferential surface 118 of each cup through hole 116*b* is exposed radially inward. This enables a water droplet present on an inner surface of the cup cover portion 113 to easily travel to this portion with the help of the centrifugal force. This enables the water droplet to be discharged through the cup through hole 116*b* more easily.

Figure 15:
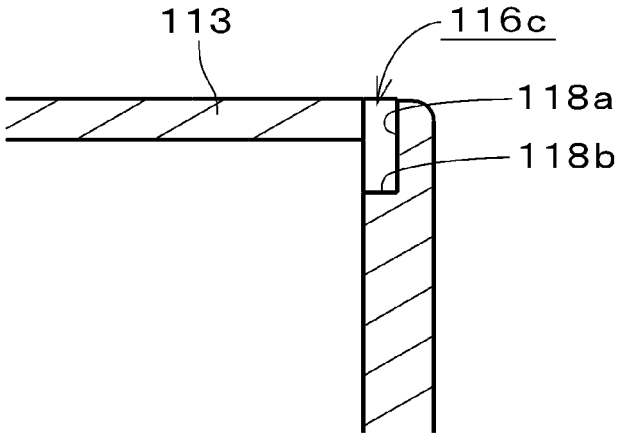
FIG. 15 is a diagram illustrating a holder through hole according to a modification of the second preferred embodiment of the present invention.

FIG. 15 is a diagram illustrating a cup through hole 116*c* according to a modification of the second preferred embodiment of the present invention. The cup through hole 116*c* preferably includes an inner circumferential surface 118*a* and a bottom surface 118*b*. The inner circumferential surface 118*a* is arranged to extend in the axial direction. The bottom surface 118*b* is arranged to extend radially inward from a lower end of a radially outer portion of the inner circumferential surface 118*a*. A lower portion of the radially outer portion of the inner circumferential surface 118*a* is arranged to be visible from a radially inner side. This enables a water droplet present on an inner surface of a cup cover portion 113 to easily travel into the cup through hole 116*c*. Note that the portion 118*c* illustrated in FIG. 14 may be considered to be a bottom surface of the inner circumferential surface 118.

While preferred embodiments of the present invention have been described above, it is to be understood that the present invention is not limited to the above-described preferred embodiments, and that a variety of modifications are possible.

For example, the cup cover portion 113 is preferably arranged to extend perpendicularly to the central axis J1 in each of the above-described preferred embodiments. Note, however, that the cup cover portion 113 may be arranged to extend only substantially perpendicularly to the central axis J1, and not exactly perpendicularly to the central axis J1. The cup cylindrical portion 114 is preferably arranged to extend in parallel with the central axis J1 in each of the above-described preferred embodiments. Note, however, that the cup cylindrical portion 114 may be arranged to extend only substantially in the axial direction, and not exactly in parallel with the central axis J1. For example, the cup cylindrical portion 114 may be inclined radially outward with decreasing height. Therefore, the boundary between the cup cover portion 113 and the cup cylindrical portion 114 may not necessarily be strictly defined. The boundary between the cup cover portion 113 and the cup cylindrical portion 114 is distinguishable according to the first preferred embodiment, whereas the sloping portion 117 is defined as a portion between the cup cover portion 113 and the cup cylindrical portion 114 according to the second preferred embodiment. Note, however, that neither the boundary nor the sloping portion need necessarily be explicitly distinguishable from one another. For example, the cup cover portion 113 and the cup cylindrical portion 114 may be joined to each other through a smooth curved surface having a large width.

No matter what shape the cup portion 111 has, the impeller 11 preferably includes the cup through holes 116 each extending through the cup portion 111 at a position overlapping with the portion or boundary between the cup cover portion 113 and the cup cylindrical portion 114. This enables water that may be present inside the cup portion 111 to be easily discharged. Portions of each cup through hole 116 may be defined in both the cup cover portion 113 and the cup cylindrical portion 114. In the case where there is the portion (hereinafter referred to as an "intermediate portion") between the cup cover portion 113 and the cup cylindrical portion 114, a portion of each cup through hole 116 may be defined in the intermediate portion with a remaining portion of the cup through hole 116 defined in the cup cover portion 113. Also, a portion of each cup through hole 116 may be defined in the intermediate portion with a remaining portion of the cup through hole 116 defined in the cup cylindrical portion 114. Furthermore, each cup through hole 116 may be defined only in the intermediate portion.

In the second preferred embodiment, the recessed portion 22 and the groove 23 may preferably be defined in the side wall portion 131, as is the case with the housing 13 illustrated in FIG. 5. Also, the side surface 212 inside of the screw hole 211 of each screw hole defining portion 21 may be an inclined surface arranged to gradually approach the central axis J1 as it extends from the inlet side toward the outlet side. Also, the number of recessed portions 22 and grooves 23 may be more than one.

In the first preferred embodiment, at least a portion of the radially inner portion of the inner circumferential surface 118 of each cup through hole 116 is preferably arranged to be visible from the radially outer side. This enables a water droplet which has traveled to this portion from an interior space of the cup portion 111 to be easily discharged out of the cup portion 111. The same is preferably true of the second preferred embodiment.

The stator 33 is preferably directly supported by the bearing housing 311 of the base portion 31 in each of the above-described preferred embodiments. Note, however, that the stator 33 may be indirectly supported by the bearing housing 311 with, for example, a spacer or the like intervening therebetween. The bearing mechanism 120 may alternatively use, for example, a ball bearing or the like. Each of the fans 1 and 1*a* may be arranged in a variety of orientations inside the refrigerator. For example, each of the fans 1 and 1*a* may be attached to the attachment target with the central axis J1 extending parallel to a horizontal direction. In this case, the recessed portion 22 illustrated in FIG. 6 is positioned on the lower side in the direction of gravity. Each of the fans 1 and 1*a* may be arranged such that an inlet of the fan 1 or 1*a* faces downward with the central axis J1 extending parallel to the direction of gravity.

Each of the fans 1 and 1*a* may be installed not only in the refrigerator but also in a variety of other devices used in a high humidity environment, such as, for example, a washing machine, a dishwasher, or the like.

Features of the above-described preferred embodiments and the modifications thereof may be combined appropriately as long as no conflict arises.

Preferred embodiments of the present invention are applicable, for example, to fans arranged to produce axial air currents.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan comprising:

a stationary portion;

a rotating portion;

a bearing mechanism that supports the rotating portion such that the rotating portion is rotatable with respect to the stationary portion;

an impeller that rotates about a central axis together with the rotating portion to produce an axial air current; and a housing; wherein the stationary portion includes:

a stator;

a base portion that directly or indirectly supports the stator; and a circuit board;

the rotating portion includes:

a rotor magnet on a radially outer side of the stator;

a rotor holder including a cylindrical magnet holding portion that holds the rotor magnet inside; and an annular portion that extends radially inward from an upper end portion of the cylindrical magnet holding portion;

the impeller includes:

a cup portion that covers the rotor holder; and a plurality of blades on an outer circumference of the cup portion; and the cup portion includes:

a cup cover portion that extends radially outward from the central axis;

a cup cylindrical portion that is cylindrical or substantially cylindrical and extends in an axial direction from an outer edge portion of the cup cover portion to surround the cylindrical magnet holding portion; and the housing including a side wall portion that surrounds the blades, the side wall portion including a recessed portion that is recessed from an edge of the side wall portion on an inlet side of the side wall toward an outlet side of the side wall, the recessed portion being defined in an uppermost surface of the inlet side of the side wall directly adjacent to an inlet of the fan; and an inner surface of the side wall portion includes a groove that extends from the recessed portion toward the outlet side.

2. The fan according to claim 1, wherein the cup portion includes a sloping portion defined between the cup cover portion and the cup cylindrical portion, and slopes toward the base portion with increasing distance from the central axis.

3. The fan according to claim 1, wherein at least a portion of a radially inner portion of an inner circumferential surface defining a cup through hole is visible from a radially outer side of the cup portion.

4. The fan according to claim 1, wherein at least a portion of a radially outer portion of an inner circumferential surface defining a cup through hole is visible from a radially inner side of the cup through hole.

5. The fan according to claim 4, wherein the cup through hole includes an axially extending inner circumferential surface and a bottom surface of the cup through hole extend radially inward from an axially lower end of a radially outer portion of the inner circumferential surface of the cup through hole.

6. The fan according to claim 1, wherein the cup portion further includes an additional cup through hole that extends through the cup cover portion on a radially inner side of a cup through hole.

7. The fan according to claim 1, wherein the annular portion includes a central opening that extends axially through a center portion of the central axis on a radially inner side of a cup through hole; and the cup through hole, the annular portion, and the rotor magnet are all axially overlapped with one another.

8. The fan according to claim 1, wherein the housing has one of a square shape, a substantially square shape, a rectangular shape or a substantially rectangular shape when viewed along the central axis;

the recessed portion is defined in one of four sides of the housing; and a portion of an inner surface of the side wall portion, the portion being included in the side in which the recessed portion is defined, inclines downward axially toward the recessed portion as an outer surface of the side wall portion faces downward axially.

9. The fan according to claim 1, wherein the side wall portion includes a screw hole defining portion that defines a screw hole into which a screw is inserted to fix the housing to an attachment target; and the screw hole defining portion includes a side surface defining a portion of an inner surface of the side wall portion, and becomes increasingly closer to the central axis as it extends from the inlet side toward the outlet side.

10. The fan according to claim 1, wherein a cup through hole extends through the cup portion in the axial direction.

11. The fan according to claim 1, wherein the annular portion includes a holder through hole.

12. The fan according to claim 11, wherein the holder through hole and a cup through hole are arranged at a same circumferential position.

* * * * *